US005769154A

United States Patent [19]

Adkins et al.

[11] Patent Number: 5,769,154

[45] Date of Patent: Jun. 23, 1998

[54] HEAT PIPE WITH EMBEDDED WICK STRUCTURE

[75] Inventors: Douglas Ray Adkins; David S. Shen; Melanie R. Tuck; David W. Palmer, all of Albuquerque; V. Gerald Grafe, Corrales, all of N. Mex.

[73] Assignee: Sandia Corporation, Albuquerque, N. Mex.

[21] Appl. No.: 593,596

[22] Filed: Jan. 29, 1996

[51] Int. Cl.[6] ..... F28D 15/00

[52] U.S. Cl. ..... 165/104.26; 126/96

[58] Field of Search ..... 165/104.33, 104.26; 257/715; 361/700; 126/45, 96

[56] References Cited

U.S. PATENT DOCUMENTS

| | | | |
|---|---|---|---|
| 4,015,659 | 4/1977 | Schladitz | 165/104.26 |
| 4,274,479 | 6/1981 | Eastman | 165/104.26 |
| 4,394,344 | 7/1983 | Werner et al. | 165/104.26 X |
| 4,470,451 | 9/1984 | Alario et al. | 165/104.26 |
| 4,489,777 | 12/1984 | Del Bagno et al. | 165/104.26 |
| 4,819,719 | 4/1989 | Grote et al. | 165/104.26 |
| 4,833,567 | 5/1989 | Saaski et al. | 165/104.33 X |
| 4,880,053 | 11/1989 | Sheyman | 165/104.26 |
| 5,223,747 | 6/1993 | Tschulena | 165/80.4 X |
| 5,453,641 | 9/1995 | Mundinger et al. | 165/104.26 X |

FOREIGN PATENT DOCUMENTS

| | | | |
|---|---|---|---|
| 0028990 | 2/1982 | Japan | 165/104.33 |
| 0145890 | 8/1983 | Japan | 165/104.26 |
| 0185989 | 10/1984 | Japan | 165/104.33 |
| 0064055 | 4/1985 | Japan | 361/700 |
| 0974087 | 11/1982 | U.S.S.R. | 165/104.26 |
| 0974088 | 11/1982 | U.S.S.R. | 165/104.26 |

OTHER PUBLICATIONS

Cotter, T. P., *Principles and Prospects for Micro Heat Pipes,* Proceedings of the 5th International Heat Pipe Conference, Tsukubs, Japan, 1984, pp. 328–335.

Sze, S.M., *Semiconductor Devices, Physics, and Technology,* John Wiley and Sons, New York 1985.

M. Francou, et al., "Deep and Fast Plasma Etching for Silicon Micromachining," *Sensors and Actuators,* A–46–47 (1995) 17–21.

The LIGA Technique, What are the New Opportunities?, *SUSS Report,* Third Quarter 1993, Karl SUSS America, Inc., Waterbury Center, VT.

Allen, M.G., "Polymide–Based Processes for the Fabrication of Thick Electroplated Microstructures," *Proceedings of the 7th International Conference on Solid–State Sensors and Actuators,* 1992, 60–55.

*Primary Examiner*—Ira S. Lazarus
*Assistant Examiner*—Christopher Atkinson
*Attorney, Agent, or Firm*—V. Gerald Grafe

[57] ABSTRACT

A heat pipe has an embedded wick structure that maximizes capillary pumping capability. Heat from attached devices such as integrated circuits evaporates working fluid in the heat pipe. The vapor cools and condenses on a heat dissipation surface. The condensate collects in the wick structure, where capillary pumping returns the fluid to high heat areas.

12 Claims, 5 Drawing Sheets

HEAT PIPE WITH EMBEDDED WICK STRUCTURE

This invention was made with Government support under Contract DE-AC04-94AL85000 awarded by the U.S. Department of Energy. The Government has certain rights in the invention.

BACKGROUND OF THE INVENTION

This invention relates to the field of heat dissipation devices, specifically miniature heat pipes with optimized embedded wick structures.

Increasing power density in electronic circuits creates a need for improvements to systems for transferring heat away from the circuit. Integrated circuits (ICs) typically operate at power densities of up to 17 W/cm$^2$. The power density will increase as the level of integration and speed of operation increase. Other systems like concentrating photovoltaic arrays must dissipate externally-applied heat loads. Advances in heat dissipation technology can eliminate the current need for mechanically pumped liquid cooling systems.

Heat spreaders can help improve heat rejection from integrated circuits. A heat spreader is a thin substrate that transfers heat from the IC and spreads the energy over a large surface of a heat sink. Heat transfer through a bulk material heat spreader produces a temperature gradient across the heat spreader, limiting the size and efficiency of the heat spreaders. Diamond films are sometimes used as heat spreaders since diamond is 50 times more conductive than alumina materials and therefore require a lesser temperature gradient. Diamond substrates are prohibitively expensive, however.

Heat pipes can also help improve heat rejection from integrated circuits. Micro-heat pipes use small ducts filled with a working fluid to transfer heat from high temperature devices. See Cotter, "Principles and Prospects for Micro-heat Pipes," Proc. of the 5th Int. Heat Pipe Conf. The ducts are typically straight channels, cut or milled into a surface. Evaporation and condensation of the fluid transfers heat through the duct. The fluid vaporizes in the heated region of the duct. The vapor travels to the cooled section of the duct, where it condenses. The condensed liquid collects in the corners of the duct, and capillary forces pull the fluid back to the evaporator region. The fluid is in a saturated state so the inside of the duct is nearly isothermal.

Unfortunately, poor fluid redistribution by the duct corner crevices limits the performance of the heat pipe. Fluid has only one path to return to the heated regions, and capillary forces in the duct corner crevices does not transport the fluid quickly enough for efficient operation. There is a need for a heat pipe that can spread fluid more completely and efficiently, and therefore can remove heat energy more completely and efficiently.

SUMMARY OF THE INVENTION

The present invention provides an improved heat pipe system for the removal of heat from a high temperature device. The present invention includes a wick structure specifically optimized for distributing fluid within the heat pipe system. The wick structure allows fluid flow in multiple directions, improving the efficiency of the heat pipe system. The wick structure of the present invention returns fluid to heated regions faster than previous wick structures, increasing the rate of heat rejection from the high temperature device. Faster, multidirectional fluid flow improves the performance of the heat pipe system by reducing the temperature gradient across the heat pipe system.

The region of the heat pipe system containing the wick structure is in contact with one or more high temperature sources. The heat pipe system contains a working fluid. Heat from a high temperature source vaporizes the fluid. The heated vapor travels to cooled regions of the heat pipe system, where it condenses and flows into the wick structure. The wick structure distributes the liquid over the wick structure's surface, where the liquid can again be vaporized.

The wick structure forms semiclosed cells interconnected in multiple directions. The resulting effective pore radius maximizes capillary pumping action. The capillary pumping action distributes the liquid over the wick structure faster than possible with previous wick structures, resulting in more efficient heat transfer by the heat pipe system while minimizing hot spots. The optimal liquid distribution keeps all parts of the structure saturated with liquid.

Wick structures according to the present invention can be formed by reactive ion etching of silicon substrates. The semiclosed cells can be made in several shapes, including crosses, ells, and tees. The wick structure can be bonded to the rest of the heat pipe system by boron-phosphorous-silicate-glass bonding. Acetone, water, freon, and alcohol are suitable working fluids.

Advantages and novel features will become apparent to those skilled in the art upon examination of the following description or may be learned by practice of the invention. The objects and advantages of the invention may be realized and attained by means of the instrumentalities and combinations particularly pointed out in the appended claims.

DESCRIPTION OF THE FIGURES

The accompanying drawings, which are incorporated into and form part of the specification, illustrate embodiments of the invention and, together with the description, serve to explain the principles of the invention.

DETAILED DESCRIPTION OF THE INVENTION

The present invention provides an improved heat pipe system for the removal of heat from a high temperature device.

Figure 1:
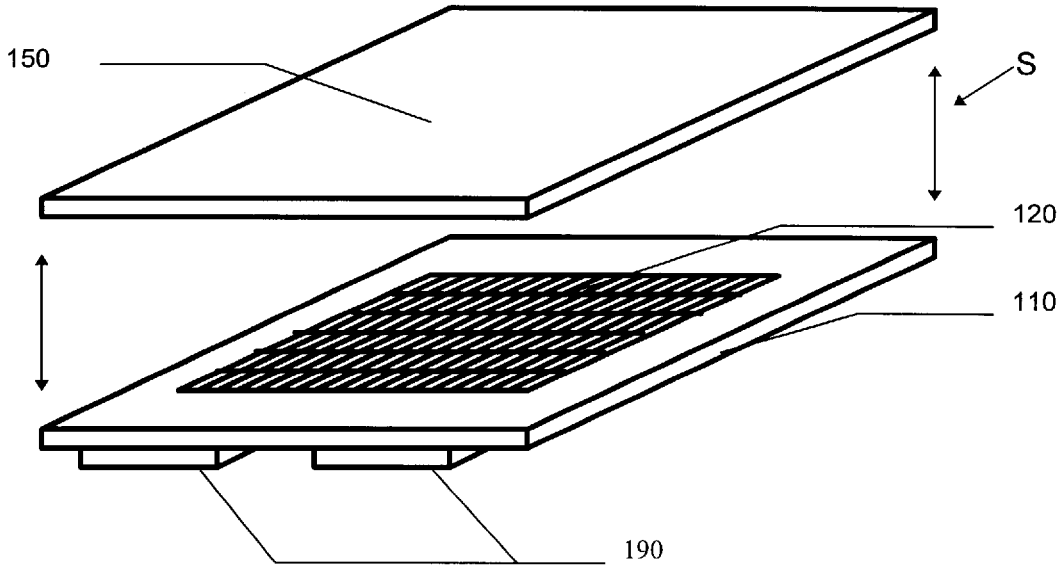
FIG. 1 is an exploded view of a heat pipe system according to the present invention.

FIG. 1 is an exploded view of a heat pipe system S according to the present invention. A high temperature device 190, such as an integrated circuit, mounts with heat pipe system S. Heat pipe system S includes a cap 150 and a wick structure 120 formed on a surface of substrate 110. A heat dissipation device, such as a conventional heat sink (not shown), mounts with cap 150. Substrate 110 sealingly engages cap 150, enclosing a volume defined by wick structure 120. The volume contains a working fluid F (not shown). In operation, heat from high temperature device 190 transfers to the working fluid F in the wick structure 120. In operation, the working fluid F evaporates from wick structure 120 and condenses on cap 150 as a consequence of transferring heat to the heat sink. The fluid flows back into wick structure 120. Capillary forces in wick structure 120 distribute the working fluid F evenly, returning cooled working fluid F to region of the wick structure where evaporation is greatest.

Figure 2:
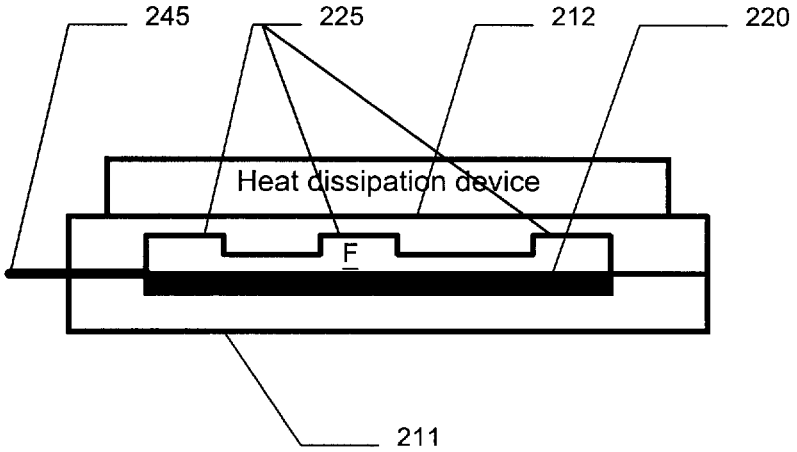
FIG. 2 is a sectional view of a heat pipe system according to the present invention.

FIG. 2 shows a cross section through a heat pipe system according to the present invention. A wick-structure 220 is formed on first substrate 211. Substrate 211 sealably mounts with a second substrate 212 and with high temperature devices (not shown). Second substrate 212 contains a plurality of vapor passages 225 formed on the surface of substrate 212 facing the wick structure 220 formed with substrate 211. A heat sink such as a cold plate (not shown) can be mounted on the opposing surface of substrate 212. Substrates 211, 212 can be made of silicon with passages 225 and wick structure 220 formed by lithography etching techniques known to those skilled in the art. The first and second substrates 211,212 can be hermetically sealed by boron-phosphorous-silicate-glass bonding. The volume formed with the wick structure 120 and between the first and second substrates 211, 212 is filled with a working fluid F.

An attached high temperature device (not shown) heats the working fluid F and vapor evaporates from heated regions of the wick structure 220 and flows via the vapor passages 225 to regions of the second substrate 212 where it is cooled by the heat sink. The vapor condenses and is pumped back to the heated regions of the wick structure 220 by capillary forces.

Capillary pumping resulting from the wick structure aids in distributing the working fluid F throughout the wick structure. The working fluid F, such as methanol, can be introduced through a port 245 into the volume and then chilled. Any non-condensed vapor can be evacuated by placing the heat pipe system in a vacuum. The port 245 can be sealed by a laser fusion weld or by epoxy filling. The heat pipe system can also be filled via an injection fill, boil off and crimp seal process known to those skilled in the art. The pipe should have at least 10% of the amount of fluid required to fully saturate the wick structure 220, and can be filled with about 10% more fluid than required to fully saturate the wick structure 220 at the heat pipe system's normal operating temperature. Excess fluid can interfere with the vapor flow during operation, but there should be enough fluid so that condensate droplets can bridge between the condensing surface of substrate 212 and the wick structure 220 at the ends of the vapor passages 225.

Figure 3:
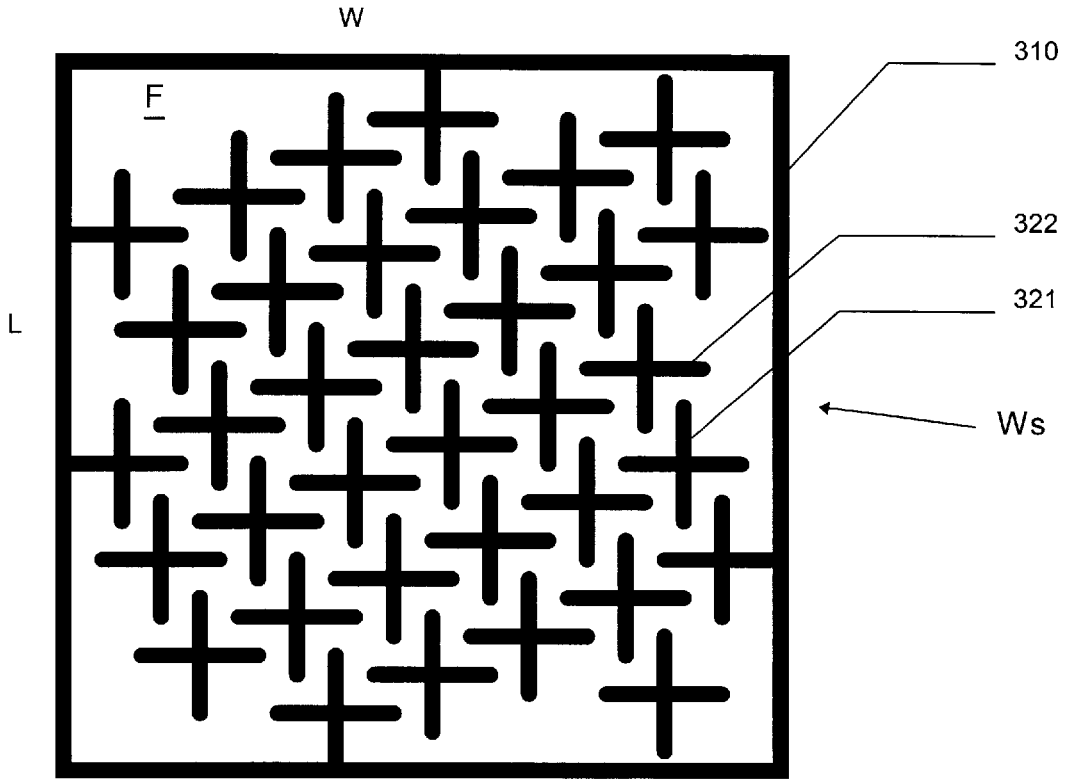
FIG. 3 is a top view of one embodiment of the invention.

FIG. 3 is a top view of the wick structure of FIG. 2 according to the present invention. Wick structure Ws comprises a plurality of cruciforms (321, 322 for example) protruding from and integral to substrate 310. Wick structure Ws has a length L and a width W. A heat generating device (not shown) attaches to the other side of substrate 310. The volume between the cruciforms contains a working fluid F. The arms of the cruciforms overlap but do not touch or completely block fluid flow within the wick structure Ws. However, the cruciforms 331, 332 are arranged so that there are no long straight fluid communication paths from one side of the wick structure Ws to the other.

Wick structures according to the present invention can be formed by several processes known to those skilled in the art. Photolithography and reactive ion etching can form suitable wick structures. See, e.g., S. M. Sze, *Semiconductor Devices, Physics, and Technology*, John Wiley and Sons, New York 1985; M. Francou, et al., "Deep and Fast Plasma Etching for Silicon Micromachining," *Sensors and Actuators*, A 46–47 (1995) 17–21. Deep-etch X-ray lithography and electroplating processing (also known by its German acronym LIGA) also can form suitable wick structures. See, e.g., A. Rogner et al., "The LIGA Technique, What are the New Opportunities?", *SUSS Report*, Third Quarter 1993, Karl SUSS America, Inc., Waterbury Center, VT; M. G. Allen, "Polyimide-Based Processes for the Fabrication of Thick Electroplated Microstructures," *Proceedings of the 7th International Conference on Solid-State Sensors and Actuators,* 1992, 60–65. Various other processes adapted to micromachining can also form suitable wick structures. Laser cutting of the substrate can also form suitable wick structures. The previously mentioned processes are intended to be examples of suitable processes. Those skilled in the art will appreciate that many processes can be adapted to form wick structures according to the present invention.

Figure 4:
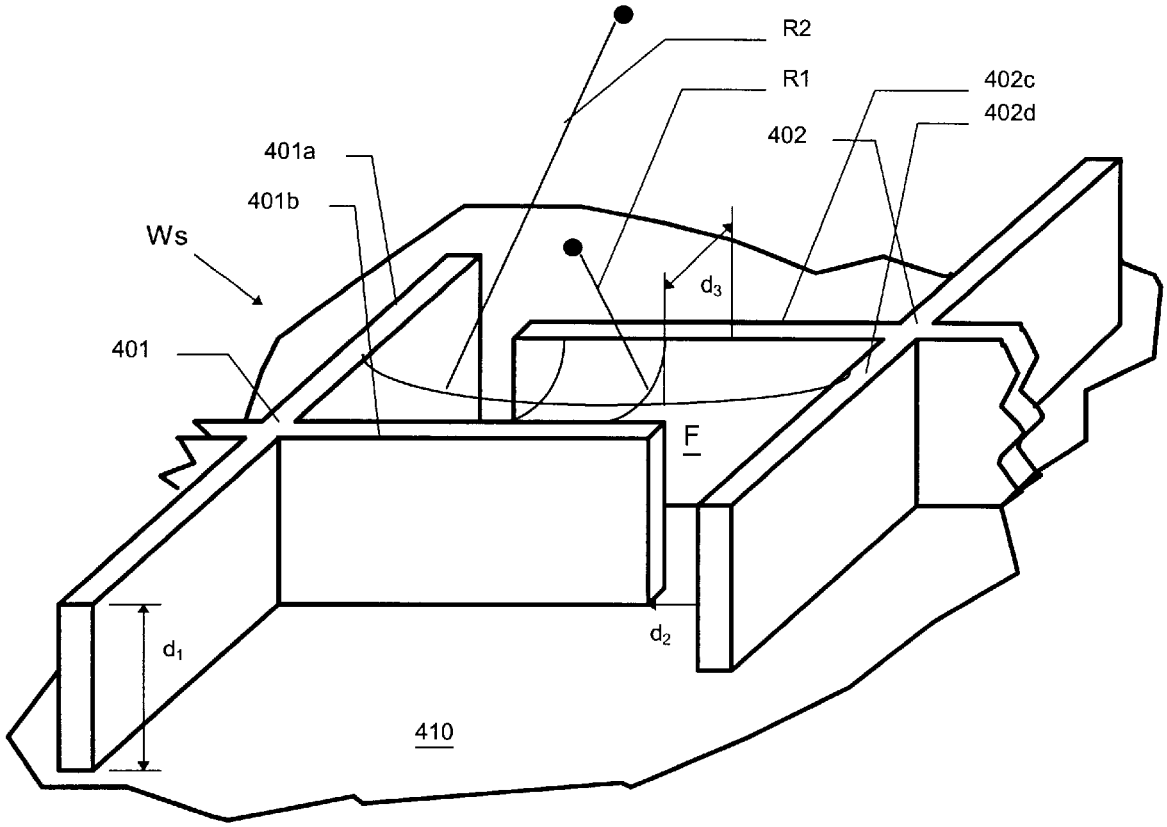
FIG. 4 is a perspective view illustrating one aspect of the present invention.

FIG. 4 is a perspective drawing of a wick structure Ws at the overlap of two cruciforms 401, 402. The cruciforms 401, 402 protrude a distance $d_1$ from substrate 410. Each cruciform 401, 402 has 4 arms extending from a central point. The cruciforms 401, 402 are separated from each other by distances $d_2$, $d_3$. Working fluid F is contained in the volume between cruciforms 401, 402. The containment of working fluid F by cruciforms 401, 402 gives rise to two meniscus radii R1, R2.

The effective pore radius (Re) of the capillary formed between cruciforms 401, 402 is given by:

$$1/Re=1/R1+1/R2. \qquad \text{EQUATION(1)}$$

For a long channel, R2 grows very large and Re is effectively R1. The overlap of cruciforms 401, 402, however, creates a semiclosed cell (bounded substantially by arms 401*a*, 401*b* and 402*c*, 402*d*) where R2 is small. Re is therefore smaller than it would be with a long channel. A channel length (one cruciform arm plus inter-arm distance $d_2$) of less than five times the cell width $d_3$ can provide suitably small Re. Smaller Re means an increase in capillary pumping capability, leading to an increased ability to distribute working fluid F throughout wick structure W. This enables the heat pipe system to achieve a greater rate of heat rejection. Each semiclosed cell is in fluid communication with neighboring semiclosed cells, forming fluid channels that can distribute fluid across the wick structure.

The arms of cruciforms 401, 402 can be about 200 $\mu$m across and about 25 $\mu$m thick, and project about 100 $\mu$m from the underlying substrate 410, with about 50 $\mu$m space between the overlapping parts. These dimensions are suitable for use with methanol as the working fluid in cooling electronic devices. The volume of working fluid accommodated depends on the volume between the cruciforms; cruciforms covering less than one half the substrate surface area and providing a cell depth of at least one fourth the minimum distance between neighboring cruciforms can accommodate suitable working fluid volumes.

If wick structure Ws contains a fluid, then the semiclosed cell widths $d_3$ can be approximately:

$$d_3=(4\sigma)/(\rho g H) \qquad \text{EQUATION(2)}$$

where $\sigma$ is the surface tension of working fluid F;

$\rho$ is the density of the liquid phase of working fluid F;

g is the gravitational acceleration; and

H is the head required to transport working fluid F against gravity and pressure drops.

EQUATION(2) gives one method of calculating cell widths $d_3$; different cell widths $d_3$ might be needed to accommodate fabrication constraints or application considerations. H will depend on the heat load on the system, the size of the heat pipe, and the orientation of the system. For example, using methanol as the working fluid at 27° C.:

$\sigma$=0.022N/m; $\rho$=784 kg/m$^3$; assuming H=0.1 m; then $d_3$=114 $\mu$m.

Figure 5:
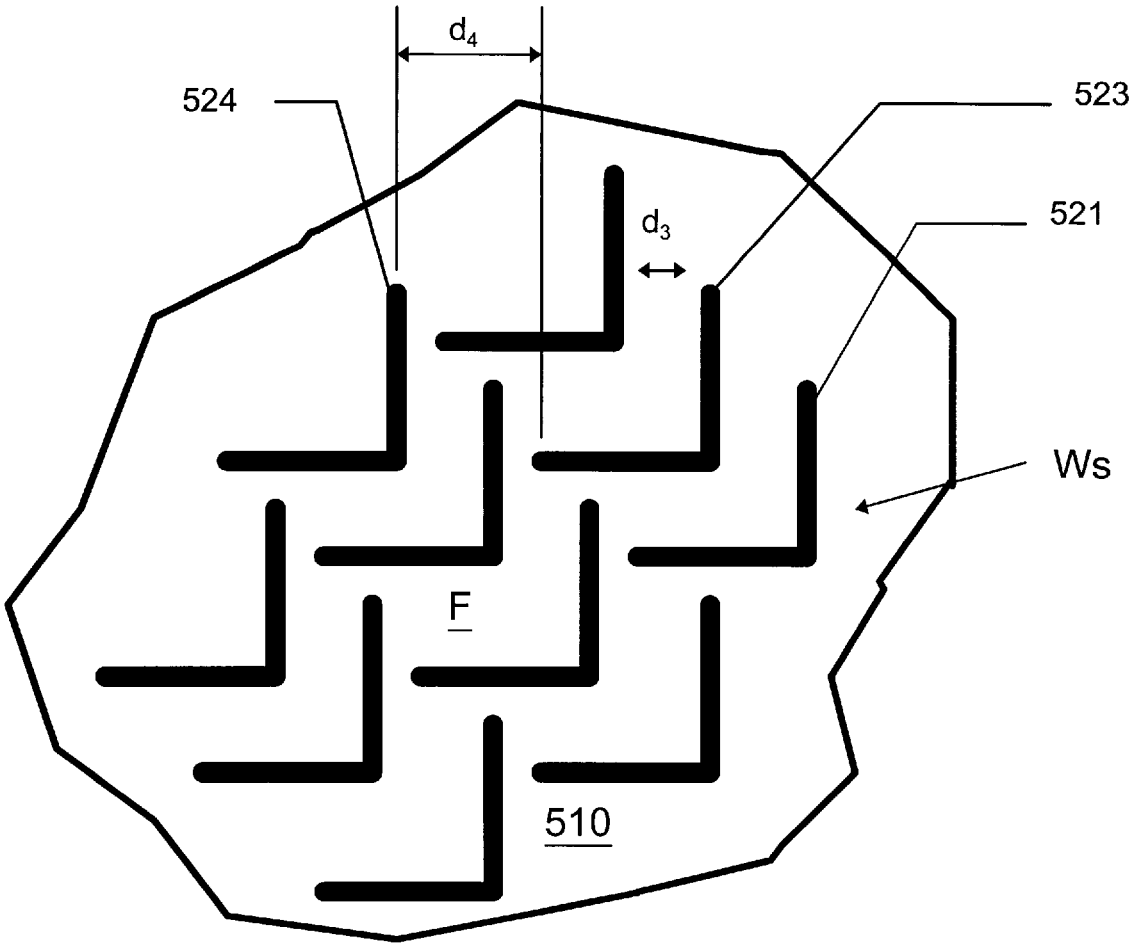
FIG. 5 is a top view of another embodiment of the invention.

FIG. 5 is a top view of another wick structure according to the present invention. A plurality of ell shapes such as 521, 523, 524 project from and are integral with substrate 510 to form wick structure Ws. Each ell overlaps its neighbors to create semiclosed cells defined by the arms of adjacent ells. Working fluid F is contained within the semiclosed cells. The effective pore radius in these cells is analogous to a cruciform wick structure, yielding the desired high capillary pumping capability. Cell width $d_3$ can be determined as discussed for a cruciform wick structure. For example, each leg of an ell can be about 150 $\mu$m long. The spacing between adjacent ells in a row (e.g., distance $d_4$ between ells 523, 524) can be about 150 $\mu$m. Subsequent rows can be about 100 $\mu$m below the preceding row and staggered by about 100 $\mu$m. Such dimensions are suitable for use with methanol to cool electronic devices.

Figure 6:
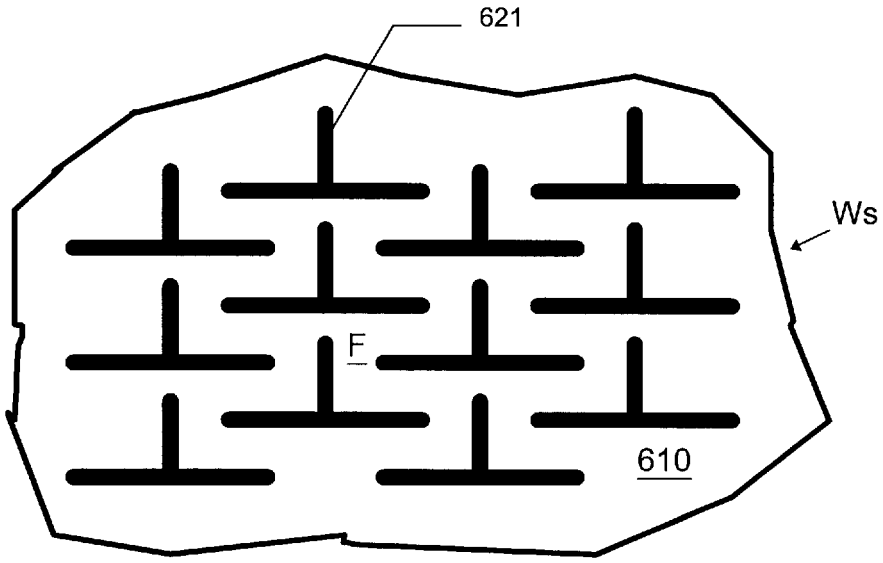
FIG. 6 is a top view of another embodiment of the invention.

FIG. 6 is a top view of another wick structure according to the present invention. A plurality of tee shapes such as 621 project from and are integral with substrate 610 to form wick structure Ws. The tees overlap to form semiclosed cells defined by the bases and stems of adjacent tees. Working fluid F is contained in the semiclosed cells. The effective pore radius in these cells is analogous to that in a cruciform wick structure, yielding the desired high capillary pumping capability. For cooling electronic devices, using methanol as the working fluid, the tees can have bottoms about 300 $\mu$m across. The stems can be about 150 $\mu$m long, with an inter-tee spacing of about 100 $\mu$m. The tees can project about 100 $\mu$m above the underlying surface.

Figure 7:
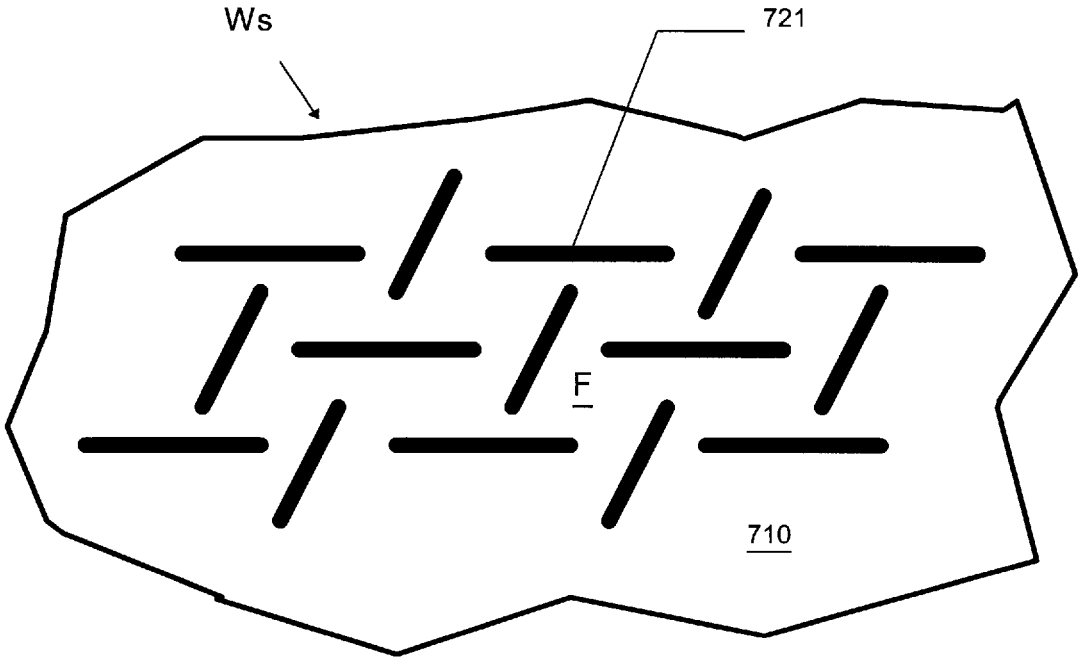
FIG. 7 is a top view of another embodiment of the invention.

FIG. 7 is a top view of another wick structure according to the present invention. A plurality of line segments of opposing orientations such as 721 protrude from and are integral with substrate 710 to form wick structure Ws. The line segments overlap to form semiclosed cells. The effective pore radius in these cells is analogous to a cruciform wick structure, yielding the desired high capillary pumping capability. For cooling electronic devices, using methanol as the working fluid, the line segments can be about 150 $\mu$m long with adjacent rows about 100 $\mu$m apart. The line segments can protrude from substrate 710 about 100 $\mu$m.

Those skilled in the art will appreciate that the present invention can be practiced with other shapes and arrangements of projections. A plurality of projections can be arranged on a surface. The projections must be arranged to form semiclosed cells, for example by orienting one subset of projections along a first direction and another subset of projections along a second direction at an angle to the first direction. Each projection should be separated from other projections with the same orientation to form one set of bounds for the semiclosed cells. The projections along the second direction should be arranged so that they form the remaining bounds for semiclosed cells. If all the cells are bounded, then there will be no long straight fluid communication paths through the wick structure. To realize the benefits of semiclosed cells, the distance from a projection along the first direction to the nearest projection along the second direction can be less than one half the length of the second projection.

The particular sizes and equipment discussed above are cited merely to illustrate particular embodiments of the invention. It is contemplated that the use of the invention may involve components having different sizes and characteristics as long as the principle, the use of semiclosed cells to increase capillary pumping in a heat pipe wick structure, is followed. It is intended that the scope of the invention be defined by the claims appended hereto.

We claim:

1. A wick structure comprising a substrate having a surface with a width and a length not less than the width, and a plurality of projections disposed on the surface in an arrangement so that no straight fluid communication path can be drawn across the surface that does not intersect at least one projection, wherein the surface defines an x axis disposed along the surface, and a y axis disposed along the surface at an angle to the x axis, and wherein the projections comprise:

a) a plurality of first projections extending from the surface, where each of the first projections has a length along the x-axis and extends from a first point (x1, y1) to a second point (x1, y2);

b) a plurality of second projections extending from the surface, where each of the second projections has a length along the y-axis and extends from a first point (x1, y1) to a second point (x2, y1); and wherein the arrangement comprises:

c) each first projection separated from every other first projection by at least one of: a first x-distance along the direction of the x axis, and a first y distance along the direction of the y axis;

d) each second projection separated from every other second projection by at least one of: a second x-distance along the direction of the x axis, and a second y-distance along the direction of the y axis; and e) where every line parallel to the y axis encounters at least one second projection and every line parallel to the x axis encounters at least one first projection.

2. The wick structure of claim 1 wherein each projection extends from the surface a distance at least one fourth the minimum of: the first x-distance, the second x-distance, the first y-distance, and the second y-distance between neighboring projections.

3. The wick structure of claim 1 wherein the projections cover less than one half of the total surface area of the substrate.

4. The wick structure of claim 1 wherein:

a) the arrangement further comprises each second projection intersecting a corresponding first projection;

b) the distance parallel to the y axis from any first projection to the nearest second projection is less than one half the length of the first projection; and c) the distance parallel to the x axis from any second projection to the nearest first projection is less than one half the length of the second projection.

5. The wick structure of claim 4 wherein each second projection intersects the corresponding first projection near the middle of the second projection and near the middle of the first projection.

6. The wick structure of claim 4 wherein each second projection intersects the corresponding first projection near the end of the second projection and near the middle of the first projection.

7. The wick structure of claim 4 wherein each second projection intersects the corresponding first projection near the end of the second projection and near the end of the first projection.

8. A heat pipe system for removing heat from a heat source comprising:

a) a wick structure comprising:

i) a substrate having a surface with a width and a length not less than the width and wherein the surface defines an x axis disposed along the surface, and a y axis disposed along the surface at an angle to the x axis; and ii) a plurality of projections comprising:

a) plurality of x-projections from the surface, where each x-projection has a length and extends from a first point (x1, y1) to a second point (x1, y2);

b) a plurality of y-projections from the surface, where each y-projection has a length and extends from a first point (x1, y1) to a second point (x2, y1); and iii) wherein the projections are disposed on the surface in an arrangement comprising:

a) each x-projection separated from every other x-projection by at least a first x-distance along the direction of the x axis and at least a first y distance along the direction of the y axis;

b) each y-projection separated from every other y-projection by at least a second x-distance along the direction of the x axis and at least a second y-distance along the direction of the y axis; and c) where every line parallel to the y axis encounters at least one y-projection and every line parallel to the x axis encounters at least one x-projection b) a cap sealably mounted with the wick structure substrate so that the wick structure and the cap enclose a volume, the cap further comprising a vapor channel that allows vapor to flow from one region of the cap to another region of the cap;

c) a fluid within the volume.

9. The heat pipe of claim 8 where the cap is mounted to the wick structure substrate by boron-phosphorous-silicate-glass bonding.

10. The heat pipe of claim 8 further comprising a plurality of vapor channels in the cap.

11. The heat pipe of claim 8 further comprising means for mounting a heat dissipation device to the cap.

12. The heat pipe of claim 8 wherein the fluid is chosen from: alcohol, freon, water, acetone.

* * * * *